US005839297A

United States Patent [19]

Swint

[11] Patent Number: 5,839,297

[45] Date of Patent: Nov. 24, 1998

[54] OUT OF BALANCE SENSOR AND CONTROL METHOD FOR A TEXTILE PROCESSING MACHINE

[75] Inventor: Mark O. Swint, Wichita Falls, Tex.

[73] Assignee: White Consolidated Industries, Inc., Cleveland, Ohio

[21] Appl. No.: 873,040

[22] Filed: Jun. 11, 1997

[51] Int. Cl.[6] ..... D06F 33/02; D06F 37/22

[52] U.S. Cl. ..... 68/12.06; 68/23.1; 68/140

[58] Field of Search ..... 68/12.06, 23.1, 68/23.3, 140; 210/144; 494/82

[56] References Cited

U.S. PATENT DOCUMENTS

| | | |
|---|---|---|
| 3,422,957 | 1/1969 | Fosler . |
| 3,447,686 | 6/1969 | Houser . |
| 3,548,615 | 12/1970 | Ohnishi et al. . |
| 3,583,182 | 6/1971 | Matsuura . |
| 3,674,419 | 7/1972 | Tichy . |
| 3,997,751 | 12/1976 | McNally . |
| 4,449,383 | 5/1984 | Cartier . |
| 4,479,371 | 10/1984 | Fesmire et al. . |
| 4,517,695 | 5/1985 | Hoffmann et al. . |
| 4,677,291 | 6/1987 | Ellingson . |
| 5,029,458 | 7/1991 | Obata et al. . |
| 5,038,587 | 8/1991 | Harmelink . |
| 5,050,407 | 9/1991 | Wild . |
| 5,165,260 | 11/1992 | Geiger . |
| 5,218,731 | 6/1993 | Broadbent . |
| 5,259,218 | 11/1993 | Broadbent . |
| 5,269,159 | 12/1993 | Oh . |
| 5,280,660 | 1/1994 | Pellerin et al. . |
| 5,301,522 | 4/1994 | Ikemizu et al. . |
| 5,325,677 | 7/1994 | Payne et al. . |
| 5,375,282 | 12/1994 | Dausch et al. . |
| 5,375,437 | 12/1994 | Dausch et al. . |
| 5,440,086 | 8/1995 | Kropf . |

FOREIGN PATENT DOCUMENTS

| | | | |
|---|---|---|---|
| 2146664 | 4/1985 | United Kingdom | 68/23.1 |

*Primary Examiner*—Philip R. Coe
*Attorney, Agent, or Firm*—Pearne, Gordon, McCoy & Granger LLP

[57] ABSTRACT

An industrial textile processing machine having a washing chamber supported by a support structure secured to a pedestal support. The support structure is provided with a piezoelectric dynamic sensor used to sense stress on the support structure caused by vibrations of the washing chamber that result from an unbalanced load. The sensor is electrically connected to a signal conditioner which is, in turn, connected to a microprocessor that controls the machine. The sensor produces an output signal that is conditioned by a signal conditioner and then used by a microprocessor to extrapolate a control decision for the machine. The sensor is used to sense the presence of an unbalanced when the machine is operating at low speeds. If an unbalanced condition is sensed, the washer will redistribute the load so that it is sufficiently balanced before entering into high speed operation.

2 Claims, 3 Drawing Sheets

Fig.1
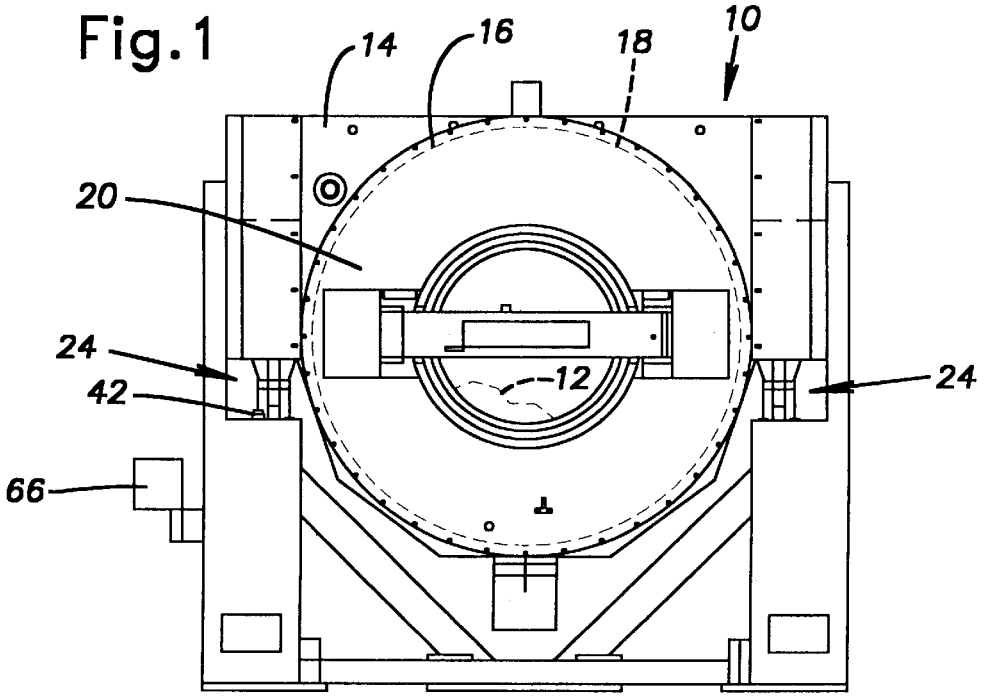
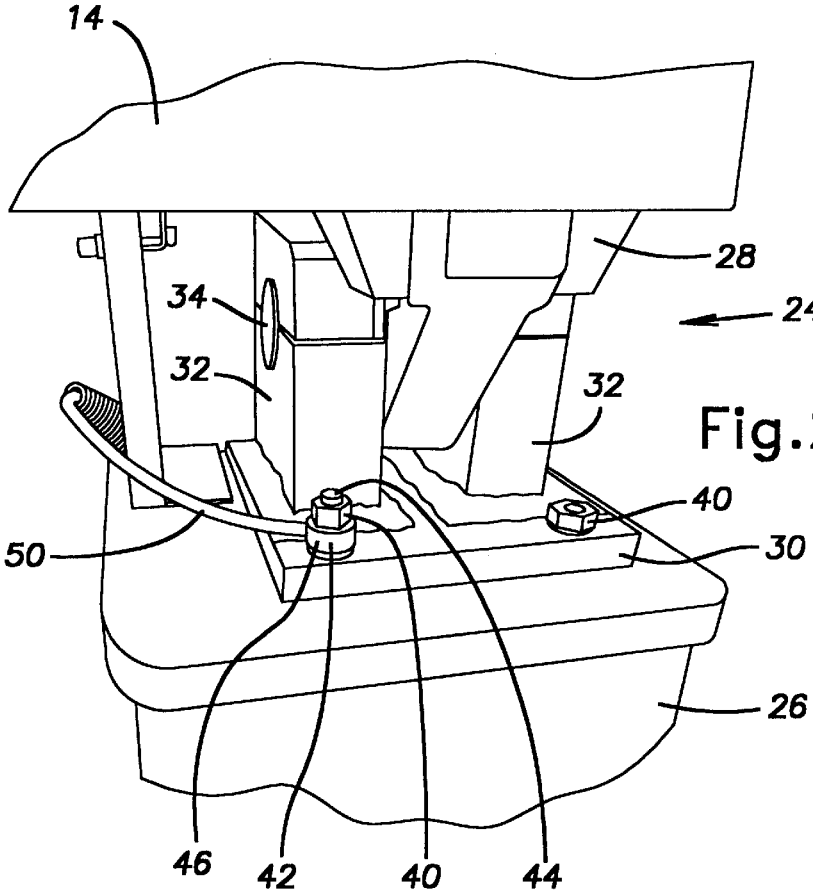
Fig.2

Fig.5
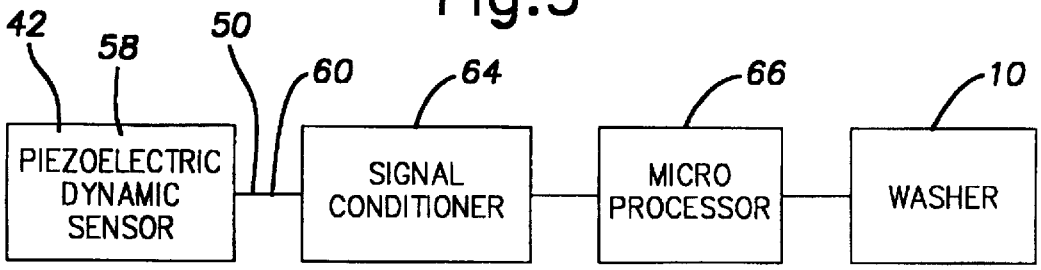
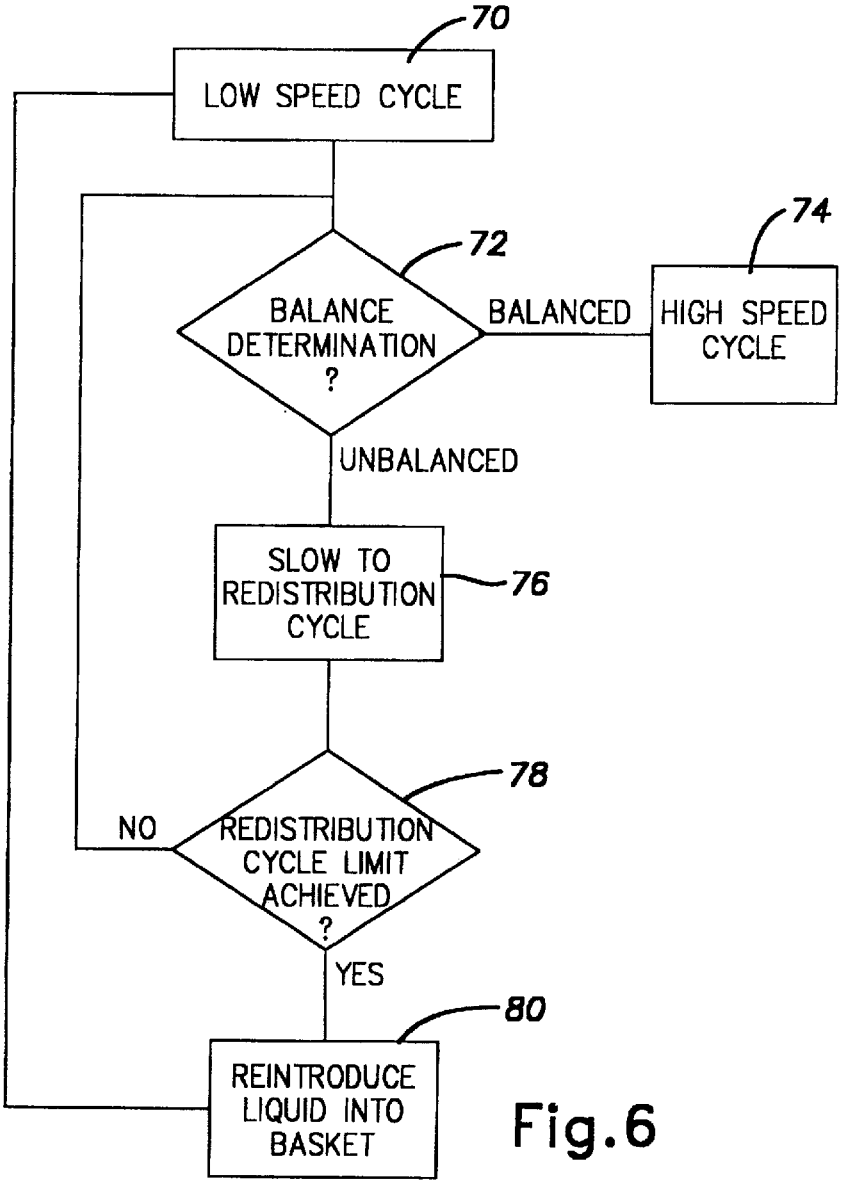
Fig.6

OUT OF BALANCE SENSOR AND CONTROL METHOD FOR A TEXTILE PROCESSING MACHINE

BACKGROUND OF THE INVENTION

1. Field of the Invention

The present invention relates to an industrial textile processing machine and more specifically to a piezoelectric sensor used to measure stress levels caused by an unbalanced load within the machine and a control method for achieving a balanced load.

1. Description of the Related Art

Industrial textile processing machines are well known. When operating with an unbalanced load, these machines develop mechanical forces that cause undesired stress and fatigue on the equipment. It is known to use devices for sensing these mechanical forces and, when they are present, correct the unbalanced load condition. A common means of determining if an unbalanced load is present is to use an optical measurement. An example of this technique is shown in U.S. Pat. No. 4,677,291 where a washer is provided with a disk mounted on the agitator and an optical sensor mounted on the frame. The disk has a detectable pattern that is sensed by the optical sensor to determine the extent of an unbalanced load condition.

Another example of unbalanced load sensing is shown in U.S. Pat. No. 5,165,260 where an industrial washer is supported on leaf springs that incorporate strain gauges therein. The strain gauges measure the weight of the load and sense unbalanced conditions. The measurements are used to initiate redistribution of the load. Another technique is shown in related U.S. Pat. Nos. 5,218,731 and 5,259,218 where a washer is provided with hydraulic cylinders for reducing vertical and horizontal unbalanced forces. Linear velocity-displacement transducers provided on the cylinders and load cells mounted on the frame are used to measure forces on the washer. The cylinders are controlled according to measured forces.

U.S. Pat. No. 3,548,615 shows a washer that senses tub exertions in the horizontal direction by use of a proximity switch and in the vertical direction by a piezoelectric device. The speed of the washer is controlled according to the amplitude of the excursions.

These techniques for sensing unbalanced conditions, however, employ complicated apparatus. Additionally, many of the known out of balance sensors will not effectively function in an industrial textile processing machine, where the machine differs significantly from that of a domestic clothes washer.

SUMMARY OF THE INVENTION

The present invention overcomes these disadvantages by providing a simple, yet effective sensing device for sensing unbalanced load conditions within an industrial textile processing machine.

Accordingly, a first embodiment of the invention provides an industrial textile processing machine having a washing chamber supported by a yoke. The yoke, which includes a base plate, is secured to a pedestal support using a bolt. The bolt extends through a ring-shaped piezoelectric dynamic sensor used to sense vibrations of the washing chamber caused by an unbalanced load.

In further accordance with the first embodiment, the sensor is electrically connected to a signal conditioner which is, in turn, connected to a microprocessor that controls the machine.

A second embodiment of the invention provides an industrial textile processing machine having a washing chamber supported by an air bag. The air bag is secured to a pedestal support and is in fluid communication with a valve. The valve is connected to a piezoelectric dynamic sensor used to sense vibrations of the washing chamber caused by an unbalanced load.

In further accordance with the second embodiment, the sensor is electrically connected to a signal conditioner which is, in turn, connected to a microprocessor that controls the machine.

The invention also provides a method of controlling an industrial textile processing machine where the sensor of the first or second embodiments is used to sense the physical stress exerted on the bolt or air bag, respectively, and to produce an output signal. The output signal is conditioned by a signal conditioner and then used by a microprocessor to extrapolate a control decision for the machine.

The sensor is used to sense the presence of an unbalanced load when the machine is operating at low speeds. If an unbalanced condition is sensed, the washer will redistribute the load so that it is sufficiently balanced before entering into high speed operation. This eliminates undesired stress and fatigue on the equipment that will otherwise cause a decrease in the machine's performance, a reduction in the machine's life-span, machine stoppages, the use of more water and energy by requiring an extract retry cycle where liquid is reintroduced into the basket to redistribute the load, and the loss of about 2 minutes per unbalance.

BRIEF DESCRIPTION OF THE DRAWING

These and further features of the present invention will be apparent with reference to the following description and drawings, wherein:

FIG. 1 is a front elevational view of an industrial textile processing machine according to the first embodiment of the present invention;

FIG. 2 is a perspective view of a sensor and yoke support according to the first embodiment of the present invention;

FIG. 5 is a block diagram of a control system according to both embodiments of the present invention; and FIG. 6 is a flow chart diagram of the washer's operation according to both embodiments of the present invention.

DETAILED DESCRIPTION OF THE INVENTION

Figure 3:
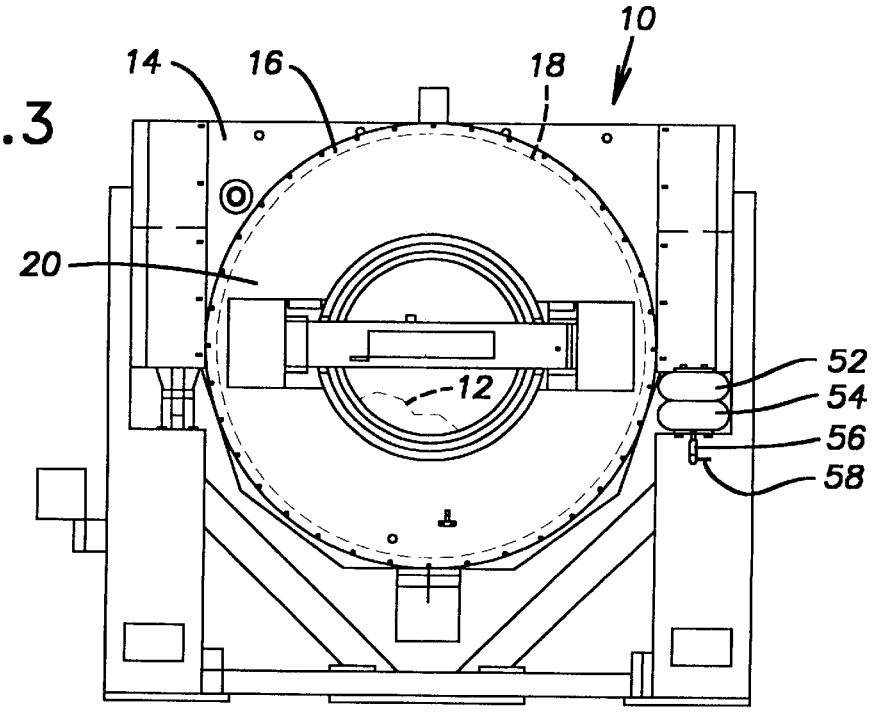
FIG. 3 is a front elevational view of an industrial textile processing machine according to the second embodiment of the invention.

In the detailed description which follows, identical components have been given the same reference numerals, and, in order to clearly and concisely illustrate the present invention, certain features may be shown in somewhat schematic form.

Referring to FIG. 1, an industrial textile processing machine, or washer 10, according to the first embodiment of the invention, is shown. The washer 10 is used to clean or otherwise process textiles, or load 12, and is provided with a horizontal axis washing chamber 14. The washing chamber 14 is comprised of an outer drum 16 and a rotationally driven inner basket 18 that receives the textiles 12 though a door 20. The washing chamber 14 is mounted on yoke supports, or yokes 24, in the front and air bags (not shown) in the rear. The yokes 24 and air bags are supported by pedestal supports 26 which are preferably constructed of rigid metal. The rear air bags are normally deflated so that the rear of the washing chamber 14 is essentially supported on the rear supports without any cushioning. When the washer 10 enters into an extraction cycle, the air bags are inflated so that the rear of the washing chamber 14 is supported by a motion absorbing air cushion.

Referring now to FIG. 2, the yokes 24 are comprised of an arm 28 directly connected to the washing chamber 14, a base plate 30 attached directly to the supports 26, a pair of stanchions 32 integrally formed with the base plate 30 and a pin 34. The pin 34 is inserted through the stanchions 32 and the arm 28 so that the washing chamber 14 and arm 28 are pivotally mounted on the supports 26. The washing chamber 14 pivots backward to assist in loading the textiles 12 and forward to assist in unloading the textiles 12. The base plate 30 is secured to the supports 26 preferably using bolts 40, or equivalently a threaded rod and nut.

One of the bolts 40 is provided with a ring-shaped piezoelectric dynamic sensor 42. The center of the sensor 42 defines a hole, through which a shaft 44 of the bolt 40 (or threaded rod) extends. The piezoelectric sensor 42 is provided with a protective outer casing 46. A multi-wire cable 50 is used to supply electrical power to the sensor 42 and, as will be described in more detail below, is used to output a voltage from the sensor 42.

The sensor 42 measures dynamic physical stresses placed on the sensor 42. Hence, any changes in force exerted on the bolt 40 as a result of the rotation of the basket 18 will be sensed by the sensor 42. When the textiles 12 contained in the basket 18 become unbalanced due to unequal distribution, the centrifugal force of the rotating basket 18 will cause vibration and physical movement of the entire washing chamber 14. At high speed rotation of the basket 18, an undistributed load will cause enough vibration to result in undesired stress and fatigue on the washer 10, will decrease washer 10 performance, and will ultimately cause the machine to stop. Therefore, it is desirous to monitor vibrations of the washing chamber 14 and correct the unbalance causing the vibrations during low speed rotation of the basket 18. The shape and placement of the sensor 42 of the first embodiment is highly advantageous for vibration monitoring since it will detect movement of the washing chamber 14 in any direction.

Figure 4:
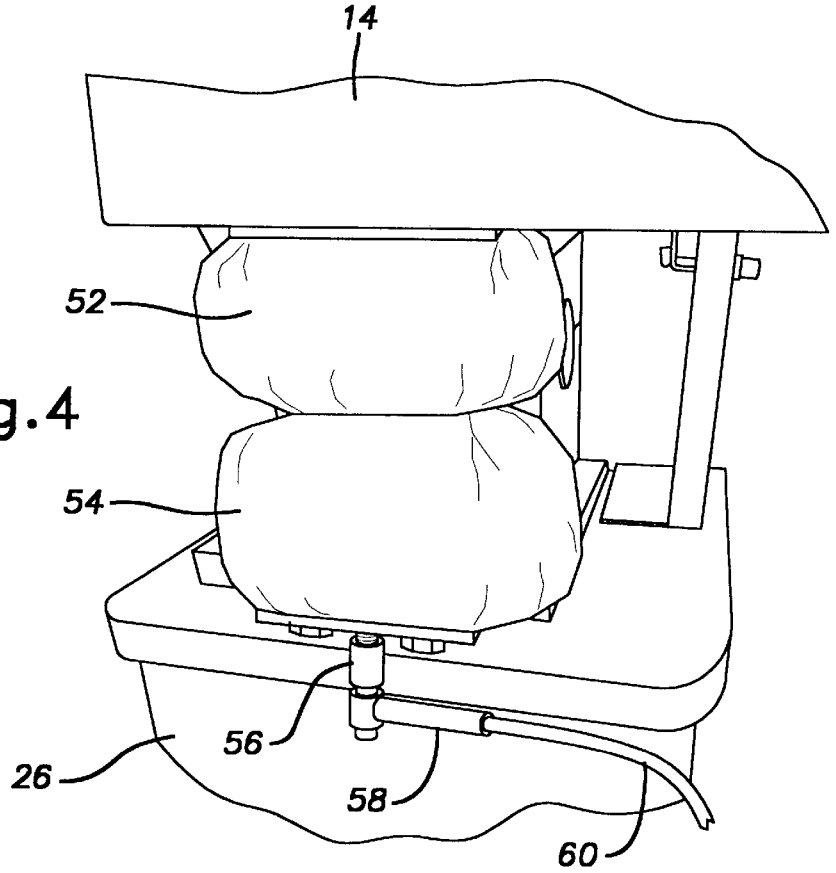
FIG. 4 is a perspective view of a sensor and yoke support according to the second embodiment of the present invention.

Referring now to FIGS. 3 and 4, a second embodiment of the invention is shown. The second embodiment replaces one of the yokes 24 supporting the front of the washing chamber 14 with air bags 52, 54. As shown in the drawing, two air bags 52, 54 are used to support the washing chamber 14, one stacked upon the other. The top air bag 52 is attached to the washing chamber and the lower air bag 54 is attached to the support 26. The lower air bag 54 is provided with a valve 56. The valve 56 is provided with a piezoelectric dynamic sensor 58 and cable 60 similar to the sensor 42 and cable 50 used in the first embodiment. Any vibrations caused by an unbalanced textile load 12 will result in changes in the air pressure within the air bags 52, 54. These changes in pressure will be transferred through the valve 56 and monitored by the sensor 58. The use of air bags 52, 54 and the placement of the sensor 58 in the second embodiment is also highly advantageous for vibration monitoring since it will also detect movement of the washing chamber 14 in any direction.

FIG. 5 shows a block diagram of a control system according to both embodiments of the present invention. The sensor 42 or 58 is connected, via the cable 50 or 60, to a signal conditioner 64. When changes in physical stress occur at the sensor 42 or 58, a voltage signal is output over the cable 50 or 60 to the signal conditioner 64. It should be understood that monitoring a current signal rather than a voltage signal may be employed with equivalent results. The output signal is proportional to the amount of dynamic stress that the rotating basket 18 filled with textiles 12 and/or liquids generates and is transferred through the components of the washer 10 to the sensor 42 or 58.

The signal conditioner 64 conditions the output signal from the sensor 42 or 58 by amplifying and/or electronically filtering the output signal, and outputs a conditioned signal to a microprocessor 66. The microprocessor 66 is programmed with software to use the conditioned signal to evaluate the amplitude, frequency and duration of the stresses exerted on the sensor 42 or 58. Using this information, the microprocessor 66 will extrapolate a decision of how to control the washer 10.

Reference will now be made to FIG. 6. In normal, balanced load, operation of the washer 10, the washer 10 will progress through various cycles. These cycles include a low speed rotation cycle 70 of the basket 18 and drain of any liquid in the drum 16. If the sensor 42 or 58 and microprocessor 66 determine 72 that the load 12 is balanced when the liquid is drained, the washer will enter a high speed rotation cycle 74, or extraction cycle, where any residual liquid in the load 12 will be removed.

If the microprocessor 66 determines 72 that the load 12 is unbalanced at the end of the low speed cycle 70 due to the presence of dynamic stress measured at the sensor 42 or 58, the microprocessor 66 will not instruct the washer 10 to enter into the high speed cycle 74. Rather, the microprocessor 66 will instruct the washer 10 to slow from the low speed cycle 70 to a redistribution cycle 76. The slower speed allows the load 12 to distribute more evenly within the basket 18. The redistribution cycle 76 can be repeated as necessary until an acceptable load 12 distribution is achieved. Once the load 12 is sufficiently redistributed, the washer 10 will accelerate the rotation of the basket 18 for the high speed extraction cycle 74. If necessary, a limit 78 can be placed on the number of redistribution cycles 76. If the limit 78 has been reached, then the washer 10 will perform an extract retry cycle 80 where liquid is reintroduced into the basket 18 to redistribute the load 12.

The invention will virtually eliminate high speed rotation 74 without proper distribution. This will prolong the washer's 10 life, and save water and energy by eliminating an otherwise necessary extract retry cycle 80. The invention will also reduce the overall textile 12 processing time by about 2 minutes per unbalance.

Although particular embodiments of the invention have been described in detail, it is understood that the invention is not limited correspondingly in scope, but includes all changes and modifications coming within the spirit and terms of the claims appended hereto.

What is claimed is:

1. An industrial textile processing machine comprising a washing chamber supported by a yoke secured to a pedestal support, the yoke including a base plate secured to the pedestal support with a bolt having a shaft, said shaft extending through a ring-shaped piezoelectric dynamic sensor, said sensor being operable to sense vibration of said washing chamber caused by an unbalanced load.

2. The machine according to claim 1, further comprising a cable electrically connected to the sensor and to a signal conditioner, the signal conditioner connected to a microprocessor used to control the machine.

* * * * *